US005337950A

United States Patent [19]

Bower

[11] Patent Number: 5,337,950

[45] Date of Patent: Aug. 16, 1994

[54] STACKABLE CONTAINER

[75] Inventor: Robert K. Bower, Cleveland, Tenn.

[73] Assignee: Westvaco Corporation, New York, N.Y.

[21] Appl. No.: 45,775

[22] Filed: Apr. 14, 1993

[51] Int. Cl.[5] ..... B65D 5/44

[52] U.S. Cl. ..... 229/164; 229/23 R

[58] Field of Search ..... 229/23 R, 164, 199, 229/915, 919, DIG. 11

[56] References Cited

U.S. PATENT DOCUMENTS

| | | | |
|---|---|---|---|
| 1,714,295 | 5/1929 | Bomberger | 229/164 |
| 2,493,281 | 1/1950 | Anderson, Jr. | 229/23 R |
| 2,511,189 | 6/1950 | Woodward | 229/23 R |
| 2,657,849 | 11/1953 | Paul et al. | 229/23 R |
| 3,659,774 | 5/1972 | Mielke | 229/23 R |
| 3,863,831 | 2/1975 | Wozniacki et al. . | |
| 4,058,249 | 11/1977 | Buck | 229/DIG. 11 |
| 4,427,108 | 1/1984 | Coles et al. | 229/164 |
| 4,497,408 | 2/1985 | Jes . | |
| 4,537,344 | 8/1985 | Thomas . | |
| 4,702,409 | 10/1987 | Osborne . | |
| 4,971,201 | 11/1990 | Sathre | 229/915 |
| 5,141,149 | 8/1992 | Fulton . | |

FOREIGN PATENT DOCUMENTS

| | | | |
|---|---|---|---|
| 550504 | 9/1956 | Belgium | 229/23 R |
| 469839 | 2/1992 | European Pat. Off. | 229/164 |
| 1194209 | 11/1959 | France | 229/23 R |
| 304718 | 9/1968 | Sweden | 229/DIG. 11 |
| 7800405 | 8/1979 | Sweden | 229/164 |
| 2220406 | 1/1990 | United Kingdom | 229/164 |

*Primary Examiner*—Gary E. Elkins

[57] ABSTRACT

A stackable container suitable for use in packaging and displaying soft goods or the like comprises a three-piece body consisting of a first tray portion for holding the packaged products and a pair of die cut tray arms which are affixed to the end walls of the tray to provide strength and support for the stacked containers. The side walls of the tray are partially cut away and reinforced to allow access to the packaged products when two or more containers are stacked one on the other.

6 Claims, 4 Drawing Sheets

STACKABLE CONTAINER

BACKGROUND OF INVENTION

The present invention relates to a stackable container made from die cut pieces of corrugated paperboard. The container of the present invention is particularly useful for packaging, shipping and displaying soft goods such as socks, underwear and related articles of clothing for bulk sales.

Stackable containers are well known in the art as exemplified by the following U.S. Pat. Nos., including 3,863,831 which shows a stacking container prepared from three components including a body section and two end cap sections; 4,537,344 which shows a one piece container; 4,497,408 which shows a stackable container with a locking lid; 4,702,409 which discloses another one piece construction; and, 5,141,149 which teaches a multiple use packaging and shipping container which is stackable. However, the container of the present invention is superior to the constructions shown in the above noted prior art patents since it is more economical to construct, it is simple to form, and, when set up, has exceptional stacking strength and convenience in use.

SUMMARY OF INVENTION

The present invention has for its primary object a convenient and economical container construction particularly useful for bulk sales applications.

Another object is to provide tray arms on two end walls of the container for exceptional strength and to resist bulging when two or more of the containers are stacked.

Yet a further object of the present invention is to provide easy access to the contents of the stacked containers for maximum display potential.

The foregoing and other objects of the present invention are accomplished by the provision of a three component construction comprising a primary body portion or tray wherein the goods to be shipped, stored, displayed and sold are confined, and a pair of die cut tray arms which fit over and reinforce the end walls of the tray. The side walls of the tray are preferably cut away and reinforced to provide access to products when the containers are stacked. The die cut tray arms provide exceptional strength for the stacked containers and wide supporting surfaces on which each subsequent container may be stacked.

DETAILED DESCRIPTION

Figure 1:
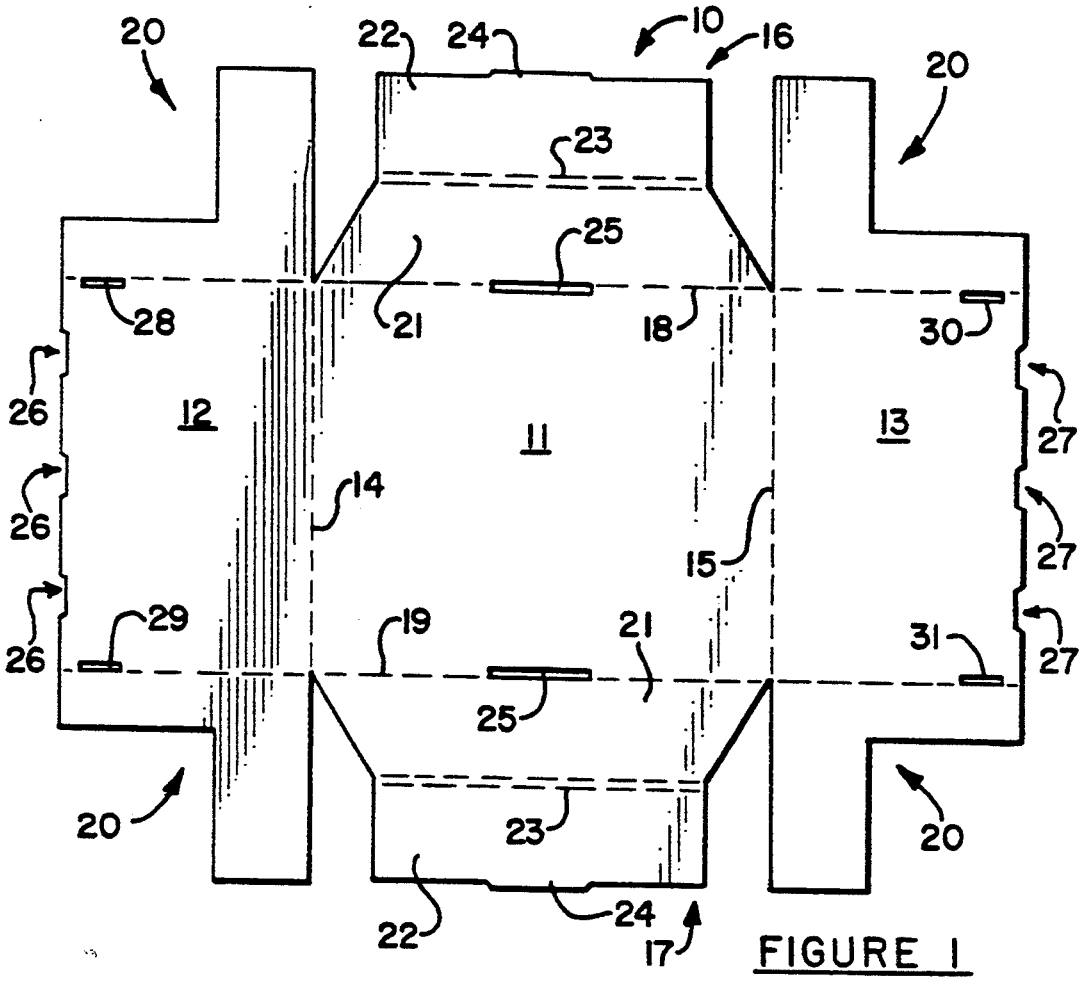
FIG. 1 is a plan view of a typical blank construction for making the primary body portion of the container of the present invention.

Referring first to FIG. 1, the blank structure 10 for the primary body portion of the container comprises a bottom panel 11, a pair of end walls 12, 13 foldably connected to the bottom panel 11 along scored lines 14, 15 and a pair of side walls 16, 17 foldably attached to the bottom panel 11 along scored lines 18 and 19. Each of the end walls 12, 13 include L-shaped extensions 20 foldably attached to the ends thereof along extensions of scored lines 18 and 19, and the side walls 16, 17 are formed in two parts, a first part 21 foldably attached to the bottom panel 11 and a second part 22 foldably attached to the first part along double scored lines 23. A locking tab 24 is provided on the outer edge of each of the second parts 22 and cooperating locking slots 25 for the tabs 24 are provided in the bottom panel 11 along the scored lines 18, 19. The end wall 12 is provided with a plurality of slots 26 equally spaced from one another along its outer edge, and the end wall 13 includes a like number of slots 27. In addition, locking slots 28, 29 and 30, 31 are provided in the end panels 12, 13 located along the scored lines 18, 19. The slots 26, 27 and locking slots 28, 29 and 30, 31 are used to attach the die cut arms to the end walls of the primary body portion when the container is constructed.

Figure 2:
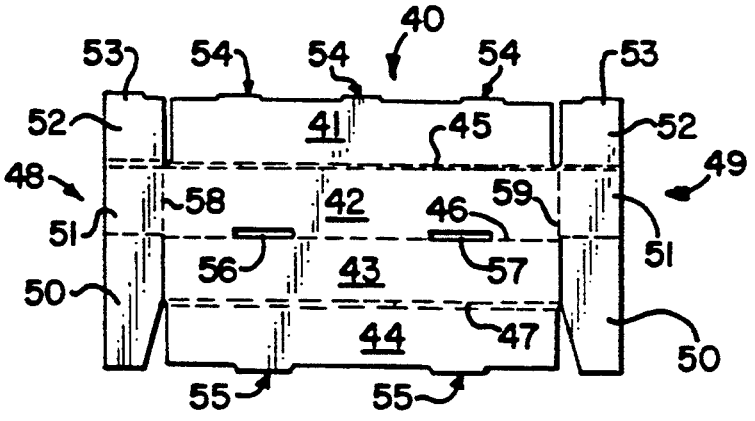
FIG. 2 is a plan view of a blank construction for making the die cut tray arms for the container of the present invention.

A typical blank structure 40 for constructing the die cut arms of the present invention is shown in FIG. 2. For this purpose, a plurality of elongated panels 41, 42, 43 and 44 are connected to one another along score lines 45, 46 and 47. In addition, a pair of end panels 48, 49 are foldably connected to the elongated panel 42 along score lines 58, 59. Each of the end panels 48, 49 are divided into a first reinforcing panel 50, an end cap 51, and a locking flap 52 which includes an integral locking tab 53. Meanwhile elongated panel 41 includes locking tabs 54 located along a free edge, and elongated panel 44 includes locking tabs 55 located along a free edge. The blank is completed with a pair of locking slots 56, 57 located along score line 46 between elongated panels 42, 43.

Figure 3:
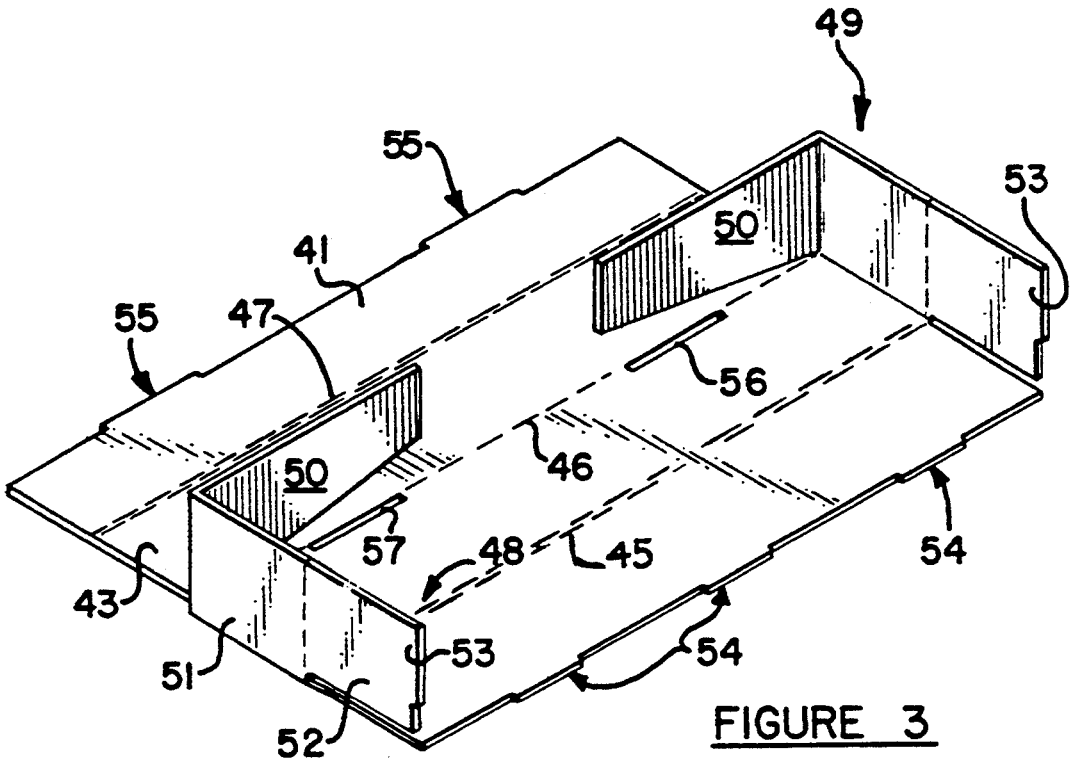
FIG. 3 is a perspective view showing a first folding step for setting up one of the tray arms of the present invention.
Figure 4:
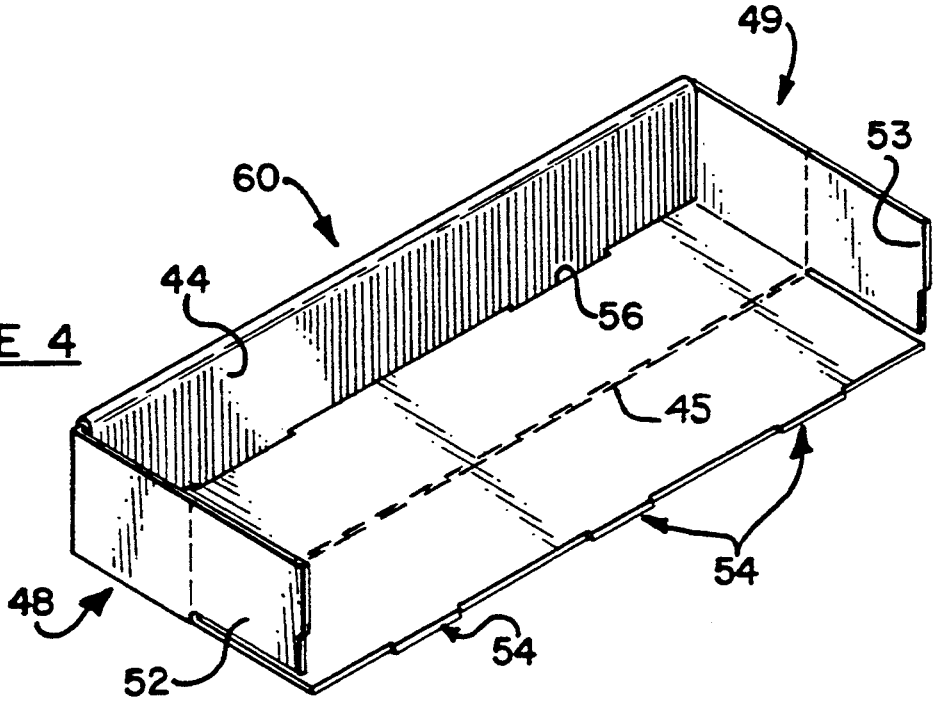
FIG. 4 is a perspective view showing a second folding step for the tray arms.

FIG. 3 illustrates the first step in setting up the die cut arms. First, reinforcing panels 50 are folded upwardly along extensions of score line 46 and the end panels 48, 49 are folded inwardly along score lines 58, 59 to assume the position shown in FIG. 3. Next, the blank is folded along score line 46 and again along score line 47 to cause the locking tabs 55 to become engaged in the slots 56, 57 substantially as shown in FIG. 4. In this condition, the die cut arms 60 are ready for assembly on the primary body portion 61.

Figure 5:
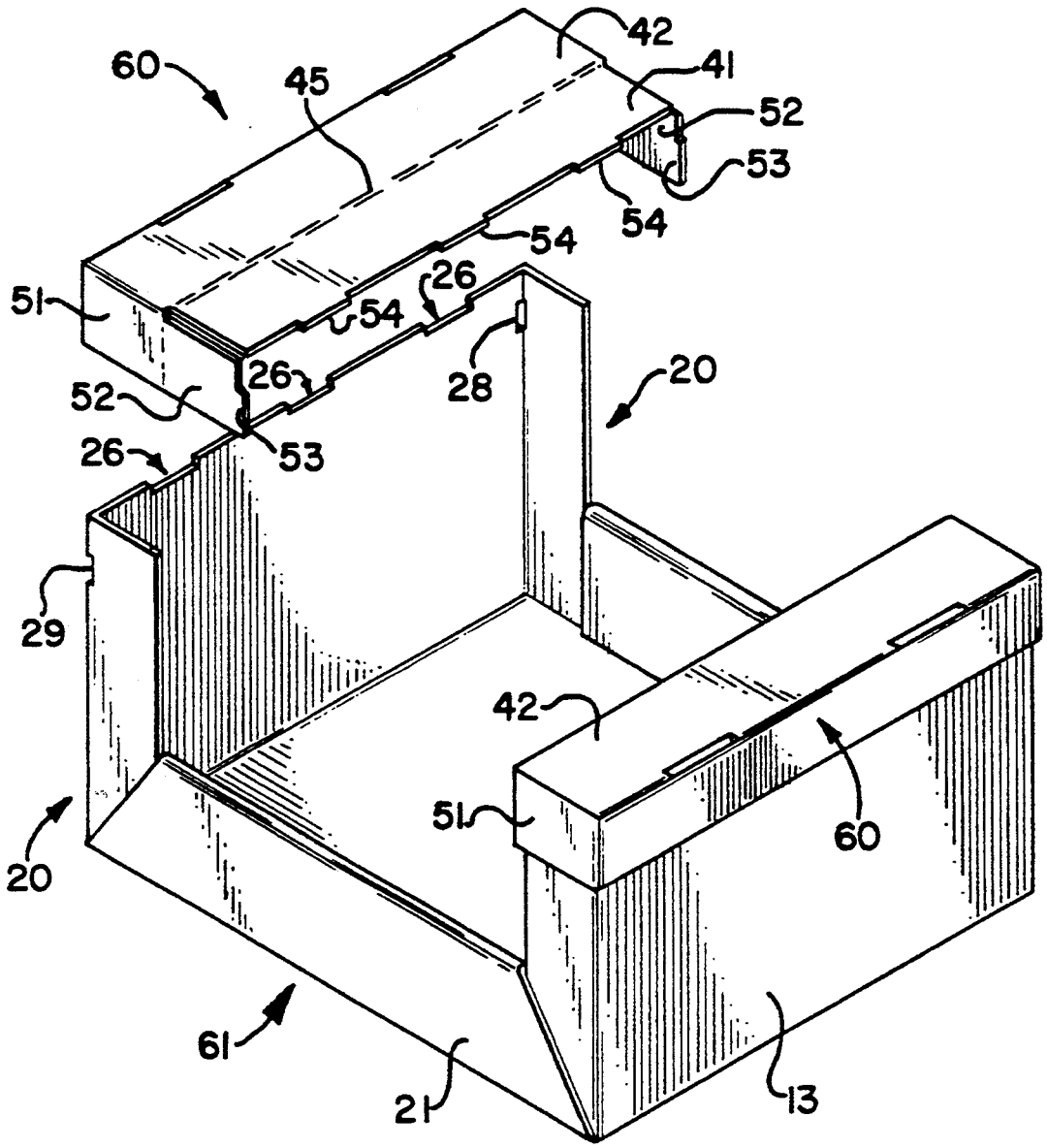
FIG. 5 is an exploded perspective view of the container of the present invention showing one tray arm in place and another in position for mounting on the end wall of the primary body portion; and, FIG. 6 is a perspective view of the completed stackable container of the present invention.

FIG. 5 illustrates the primary body portion 61 with one die cut arm 60 in place on end wall 13, and another partially assembled die cut arm 60 in position for assembly on the other end wall 12. The primary body portion 61 like the die cut arm 60 is readily set up by hand at the point of use. Although not shown in detail, the body portion is assembled as follows: first the end walls 12, 13 are folded upwardly along score lines 14, 15. Next, the L-shaped extensions 20 are folded inwardly along scored lines 18, 19 and finally the side walls 16, 17 are folded upwardly along scored lines 18, 19. At this point, the final assembly of the primary body portion 61 is completed by folding the panels 22 over about scored lines 23 where locking tabs 24 become engaged in slots 25.

Figure 6:
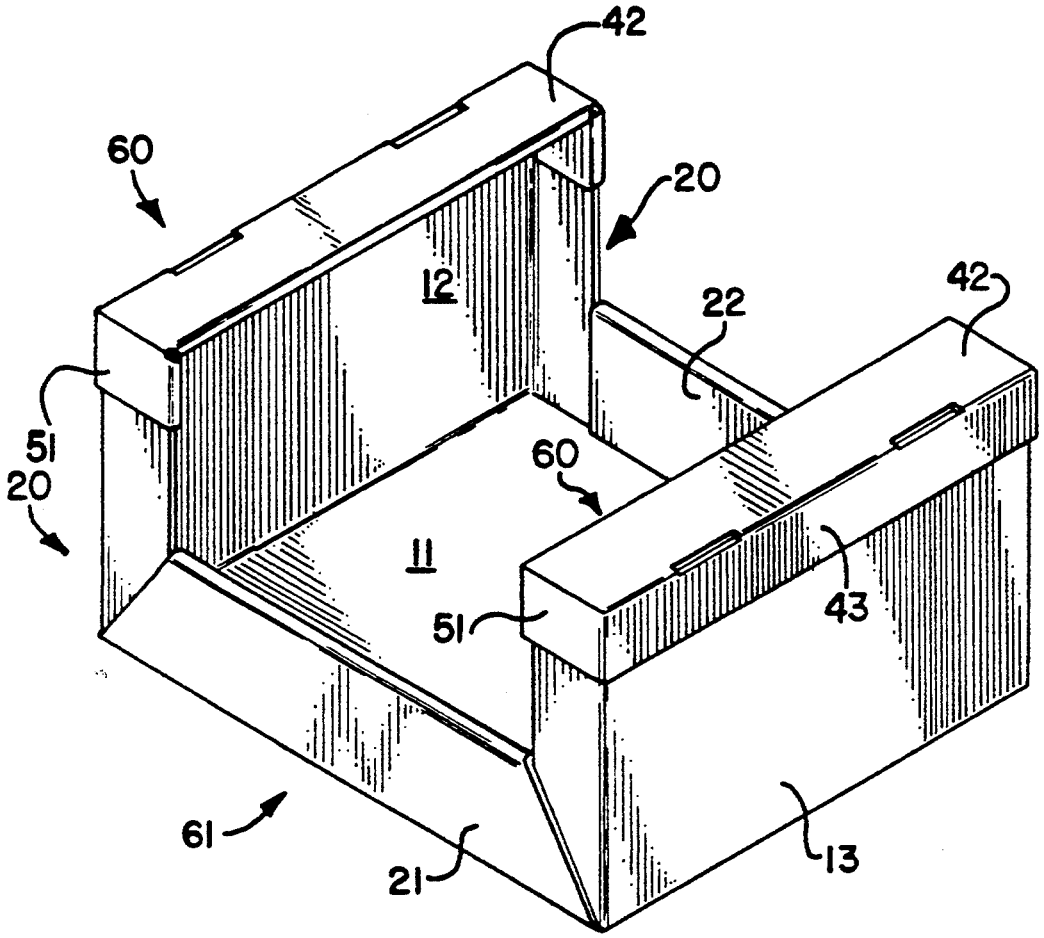

The die cut tray arm 60 is assembled on the primary body portion 61 by sliding the partially completed arm as shown in FIG. 5 downwardly over the end wall 12. At this point, the elongated panel 41 is folded around about score line 45 to engage the tabs 54 on panel 41 into the slots 26 on the end wall 12. Finally the locking flaps 52 are folded around so that the tabs 53 located on the ends thereof engage the slots 28, 29 provided at the corners of the primary body portion 61. This sequence firmly locks the die cut tray arms 60 in place so that the elongated panels 42 provide wide upper surfaces on which the next container may be stacked. A completely assembled container is shown in FIG. 6. For convenience in assembly, all score lines where the blank must be folded 180 degrees, or where one panel is folded around another, have been shown as double scores. Since each of the structures of the present invention may be completely assembled by hand without the use of staples or glue, the container may be assembled and packed with goods before shipment, or assembled and packed with goods at the point of use. In any event, a sturdy stackable con-tainer is achieved with partially cut way side walls for display and easy access to the packaged goods, and reinforced end walls for stacking.

It is to be understood that only a preferred embodiment of the invention is fully disclosed herein, and that modifications thereof are considered to be within the scope of the invention as defined in the appended claims. The terms "side walls" and "end walls", for example, are illustrative only and may be employed interchangeably for the purposes of the invention.

What is claimed is:

1. A stackable container for packaging dry goods comprising a primary body portion having a generally rectangular cross sectional shape formed from a unitary blank of paperboard, said primary body portion having a pair of full height end walls and a pair of said walls, said side walls each including abbreviated sections of full height connected to said end walls and intermediate sections of partial height between said abbreviated sections, a pair of independent tray arms formed from separate blanks of paperboard, one assembled on each of the full height end walls and the full height sections of each side wall, said tray arms each comprising a first elongated rear wall which overlaps the full height end wall, a pair of end caps which overlap the full height sections of each side wall, and a top wall located between said rear wall and the end caps to provide flat surfaces on which subsequent containers may be stacked.

2. The container of claim 1 wherein each of said tray arms comprises a plurality of elongated panels foldably connected together along spaced parallel fold lines and a pair of end panels foldably connected to one of said elongated panels.

3. The container of claim 2 wherein the elongated panels comprise a first pair which form double thick panels for said rear wall and a second pair which form double thick panels for said top wall.

4. The container of claim 3 wherein the end panels are divided into a first reinforcing panel which is captured between the double thick panels for said rear wall, an end cap, and a locking flap with a locking tab which engages a locking slot provided in said primary body portion.

5. The container of claim 4 wherein the double thick panels for said rear wall include an outside panel and an inside panel wherein said inside panel includes a pair of locking tabs which engage and become locked in locking slots provided therefor between the outside panel of the rear wall and the panels for said top wall.

6. The container of claim 5 wherein the double thick panels for said top wall include an outside panel and an inside panel wherein said inside panel includes a plurality of locking tabs which engage and become locked in slots provided therefor on said primary body portion.

* * * * *